US008887455B2

(12) United States Patent
Kreyling

(10) Patent No.: US 8,887,455 B2
(45) Date of Patent: Nov. 18, 2014

(54) THRESHOLD MAT

(71) Applicant: Jaime Kreyling, Collierville, TN (US)

(72) Inventor: Jaime Kreyling, Collierville, TN (US)

( * ) Notice: Subject to any disclaimer, the term of this patent is extended or adjusted under 35 U.S.C. 154(b) by 0 days.

(21) Appl. No.: 13/633,223

(22) Filed: Oct. 2, 2012

(65) Prior Publication Data

US 2013/0081339 A1 Apr. 4, 2013

Related U.S. Application Data

(60) Provisional application No. 61/542,367, filed on Oct. 3, 2011.

(51) Int. Cl.
*E04F 15/00* (2006.01)
*A47G 27/02* (2006.01)

(52) U.S. Cl.
CPC ..... *A47G 27/0206* (2013.01); *A47G 27/0212* (2013.01)
USPC ..... 52/179; 52/459; 52/469

(58) Field of Classification Search
USPC ..... 52/174, 175, 177, 179, 211, DIG. 13, 52/459, 461–463, 469; 15/215–217; 428/43, 71; 49/467, 469
See application file for complete search history.

(56) References Cited

U.S. PATENT DOCUMENTS

| | | | | |
|---|---|---|---|---|
| 535,803 | A * | 3/1895 | Marcus | 52/179 |
| 1,635,084 | A * | 7/1927 | Hyman | 52/179 |
| 4,788,726 | A | 12/1988 | Rafalko | |
| 4,879,765 | A | 11/1989 | Bailie | |
| 5,028,468 | A * | 7/1991 | Taylor | 428/71 |
| 6,216,395 | B1 | 4/2001 | Kelly | |
| 6,295,658 | B1 * | 10/2001 | Jenkins | 4/251.1 |
| 2006/0005470 | A1 | 1/2006 | Mullen | |
| 2009/0107763 | A1 * | 4/2009 | Poston, Jr. | 182/106 |

* cited by examiner

*Primary Examiner* — William Gilbert
*Assistant Examiner* — Patrick Maestri
(74) *Attorney, Agent, or Firm* — Daniel Boudwin; Global Intellectual Property Agency LLC

(57) ABSTRACT

Disclosed is a threshold mat that provides a covering over the sill or threshold of an entryway. The device comprises a thickened interior layer sandwiched between an upper and lower covering, whereby the device is positioned over a threshold and connected to the ground surface and the threshold itself using a line of connection along the underside ends of the mat. This secures the mat against the threshold to prevent a tripping hazard, while providing a padded surface for children to crawl over the threshold. An embodiment of the mat contemplates the ability to size the mat to a particular threshold width by detaching removable outer portions that remove excess material. The mat construction is one of a thickened interior layer sandwiched between water proof outer material for exterior door use.

3 Claims, 2 Drawing Sheets

THRESHOLD MAT

CROSS REFERENCE TO RELATED APPLICATION

This application claims the benefit of U.S. Provisional Application No. 61/542,367 filed on Oct. 3, 2011, entitled "Crawl Safely Threshold Mat." The above identified patent application is herein incorporated by reference in its entirety to provide continuity of disclosure.

BACKGROUND OF THE INVENTION

1. Field of the Invention

The present invention relates to baby crawling mats and doorway mats. More specifically, the present invention relates to a doorway threshold or door sill crawling mat that protects a crawling baby moving between rooms or through a doorway and into a home.

Door bottoms, thresholds and sills are areas along the base of a door frame that provide waterproofing, thermal insulation and a defined pathway for a swinging or sliding door. These areas are particularly dirty and unsanitary, as they are positioned along the ground and at a transition between an interior space and the exterior environment. It is common for these areas to collect dirt, and even deteriorate over time as the elements wear away the material or fade its appearance. Most adults have no problem ignoring this region of a home, as they can simply walk over a threshold without making direct contact. Young children, however, are of particular concern in these areas. Falls around the threshold of a doorway can cause particular injury to a child, as this area generally has raised sections, exposed doorway or sliding door elements, and further is not often cleaned with the same vigor as are interior surfaces. This exposes the child to upstanding or sharp elements, and further to particularly dirty surfaces.

The present invention is present to address several problems associated with this household area. These include providing a covered pathway for a young child or a pet to cross the threshold without becoming dirtied or injured, improving the overall aesthetics of a threshold, and in particular an aging threshold that may be discolored or chipped, and finally keeping dirt and debris from being tracked into the house and over the threshold by the user's feet. It is submitted that there is a clear need in the art for an improvement to existing thresholds, most notably a protective and shielding covering. High traffic thresholds expose young children and pets to injury, while uncovered walkways allow dirt to be tracked into the house from the outside environment. The present invention provides a covering that is designed to meet these needs while not interfering with the door operation while deployed.

The present invention provides a padded surface for which a user or pet can crawl or walk across without being exposed to sharp edges or dirty surfaces. The mat is securable to a threshold using a pair of connector elements that form lines of connection along the interior and exterior edges of the mat once installed. An embodiment of the present invention contemplates a ramp section along the exterior portion of the mat, which eliminates upstanding portions of the threshold and provides a ramped entryway for a child to crawl over. A further embodiment contemplates a mat having removable side portions to fit the base mat within doorways having varying threshold widths.

2. Description of the Prior Art

Devices have been disclosed in the prior art that relate to threshold coverings and child safety devices. These include devices that have been patented and published in patent application publications, and generally relate to covers for protecting the threshold itself, as opposed to a child traversing the threshold. The forgoing is a list of devices deemed most relevant to the present disclosure, which are herein described for the purposes of highlighting and differentiating the unique aspects of the present invention, and further highlighting the drawbacks existing in the prior art.

Specifically, U.S. Pat. No. 6,216,395 to Kelly discloses a threshold protector for use during the construction of a home or building to protect the elements of threshold from damage. The device comprises a cover having a front and rear flange and a slanted top section therebetween, whereby the flanges are adapted to secure to the inner and outer portions of a door or building threshold and secure the assembly thereto. The top section provides a cover over the door sill, while its width is such that it fits within a doorway or similar threshold width provided in the given structure being protected. The top section prevents damage from falling debris and traffic over the threshold, as the threshold elements are generally installed early in the construction of a home and prior to work being completed on other interior and exterior sections. The present invention provides a pliable mat that is adapted to provide a cushioned cover over a threshold or door sill. It is desired to provide this soft cover for the protection of a crawling child, as opposed to protection of the threshold itself. The structure and intent of the present invention differ from that of the Kelly device.

U.S. Published Patent Application Publication No. 2006/0005470 to Mullen is a device that discloses a similar device of that of Kelly, wherein a door threshold protective cover is provided having an upper surface, fasteners adapted to be placed therethrough and into the threshold, as well as an accompanying method of installation therefor. The device comprises a body having a top protective panel configured to overlie a door threshold, while at least a portion of which is translucent for placement of fasteners therethrough and into the threshold. As with the Kelly device, the Mullen disclose presents a protective cover for the threshold itself, as opposed to a cover for protecting a person or child traversing the threshold. The present invention provides a mat that can be sized to fit and secured to a threshold, wherein a child can crawl over the covered threshold without fear of splinters, contact with dirt, protruding nails or other rough surfaces that may be found on a threshold that is generally walked over and not crawled over.

The present invention provides a protective covering over a threshold mat for the protection and comfort of children crawling over the mat, not for the protective of the threshold during construction or other operations. The elements of the mat provide covering over sharp threshold objects, while the thickened interior layer of the mat provides a comfortable surface for the child to crawl along. The placement of the present covering within the threshold further does not interfere with the operation of the existing door, wherein the prior art devices otherwise be prevent a door from operating as is normally intended when installed. It is submitted that the present invention is substantially divergent in design elements from the prior art and consequently it is clear that there is a need in the art for an improvement to existing child crawling mat devices. In this regard the instant invention substantially fulfills these needs.

SUMMARY OF THE INVENTION

In view of the foregoing disadvantages inherent in the known types of threshold mats now present in the prior art, the present invention provides a new threshold mat covering, wherein the same can be utilized for providing convenience for the user when providing a comfortable and protective covering over a threshold for a child to easily and painlessly crawl thereover, while improving aesthetics of the threshold and preventing dirt from being tracked indoors.

It is therefore an object of the present invention to provide a new and improved threshold mat device that has all of the advantages of the prior art and none of the disadvantages.

It is another object of the present invention to provide a threshold mat device that snugly secures to an entryway threshold using a first and second connector, whereby the mat provides a form-fitted threshold covering that forms to the elements and geometry of the given threshold.

Another object of the present invention is to provide a threshold mat device having a thickened interior layer sandwiched between outer layers, providing a comfortable crawling or walking surface that can be positioned along exterior thresholds without fear of outdoor elements damaging the mat.

Yet another object of the present invention is to provide a threshold mat device that contemplates a ramp section for improved cushion, transition over the jutting threshold surfaces, and an easier pathway for crawling children and pets.

Another object of the present invention is to provide a threshold mat device that is adapted to improve the aesthetics of a threshold when deployed.

A final object of the present invention is to provide a threshold mat device that can be easily trimmed or adjusted to a specific threshold width using separable or folding outer elements that adjust the width of the mat accordingly.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
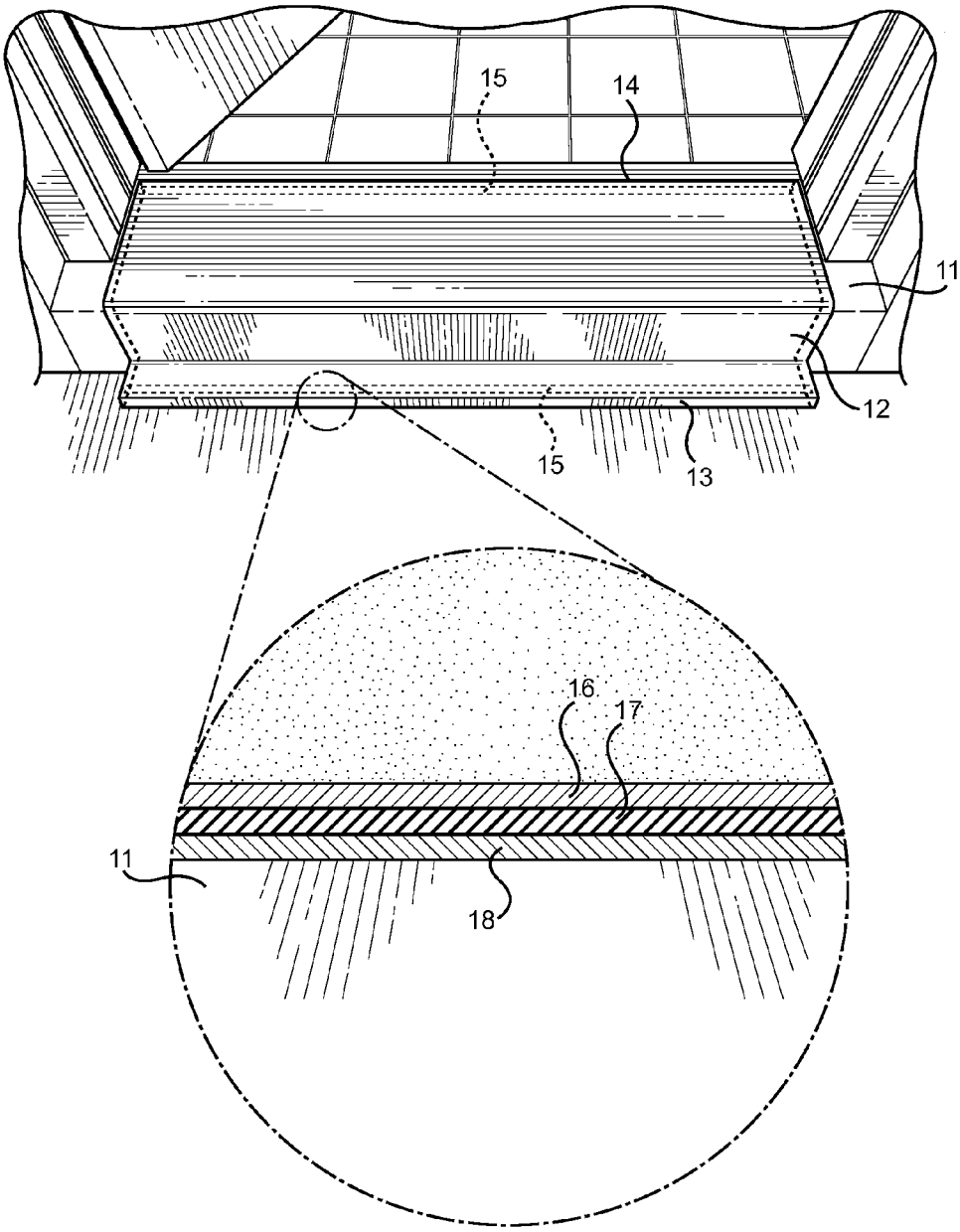
FIG. 1 shows an overhead view of the present invention in a working state, along with a call-out showing the cross section of the mat.

Reference is made herein to the attached drawings. Like reference numerals are used throughout the drawings to depict like or similar elements of the crawling mat device. For the purposes of presenting a brief and clear description of the present invention, the preferred embodiment will be discussed as used for providing a comfortable and protective covering over a threshold for young children to readily crawl thereover without risk of injury or exposure to dirt. The figures are intended for representative purposes only and should not be considered to be limiting in any respect.

Referring now to FIG. 1, there is shown an overhead perspective view of the threshold crawling mat of the present invention in an installed and working position. The mat 12 provides a slightly raised surface that is snuggly fitted to a doorway threshold 11 such that the mat contours the undulations of the threshold elements. The mat 12 is a thickened structure that offers comfort for a child crawling or walking thereover, preventing contact with any sharp elements or exposure to dirty surfaces along the threshold 11. The device secures via two lines of connection 15, which secure the inner edge 14 and outer edge 13 of the mat flush with the threshold surface to prevent movement during use and further to secure the mat to the threshold to prevent trip hazards. The inner edge 14 is abutted to the door sill or is positioned along the interior of the doorway, while the exterior edge 15 is positioned along the exterior of the doorway and away from the threshold 11. The goal is to provide a padded covering for crawling children that is easily installed and formable to any threshold geometry.

The mat construction comprises a thickened internal layer 17 sandwiched between an upper 16 and lower 18 material layer that provides weatherproofing and protection for the inner layer 17. The lower layer 18 rests against the threshold surface 11, while the upper layer 16 is in contact with a child crawling thereover. The thickness of the internal layer 17 is such that changes in the threshold geometry, sharp edges and other elements are covered with sufficient padding to prevent the child from perceiving the underlying elements and prevents injury therefrom. This internal layer may comprise of thickened rubber material or any such material that provides padding for the user to enjoy pain-free crawling or walking when traversing over the covered threshold. The structure of the mat is one that comprises an elongated body section having an interior edge 14, an opposing exterior edge 13, and lateral side edges that join the interior and exterior edges to form a rectangular surface cover.

Figure 2:
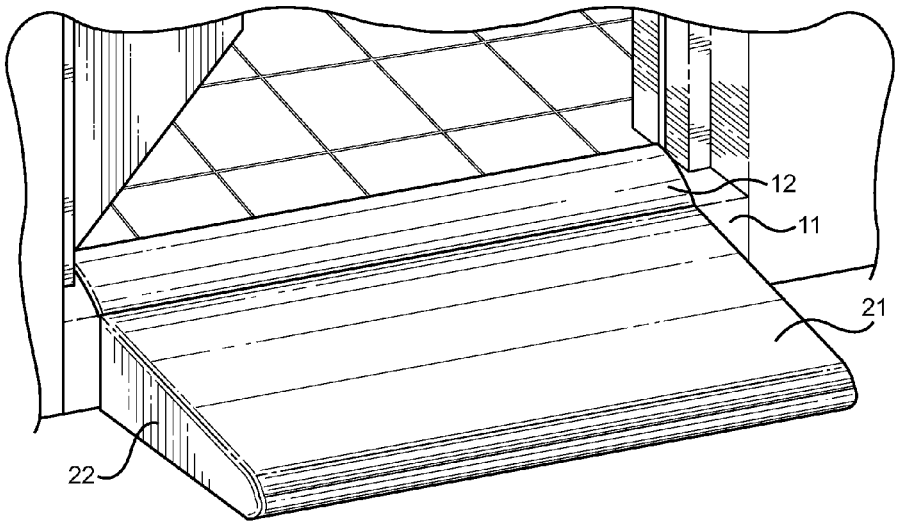
FIG. 2 shows an embodiment of the present invention in a working state, providing a ramped surface over the threshold.

Referring now to FIG. 2, there is shown a view of an alternate embodiment of the present invention. This embodiment contemplates a ramped section 21 starting from the exterior edge and moving inward, providing an inclined plane 22 upon which a child may crawl. This reduces the burden on the child when crawling over thresholds 11 having steps or sharp changes in geometry when entering or exiting over the threshold. The interior and exterior edges secure to the threshold and the exterior surface by way of the line of connection, which is preferably a strip of hook and loop fasteners, while the ramp section 21 is abutted against the threshold step. In this embodiment, the mat cross section comprises a layer of padding material beneath the interior layer, which provides the thickness for the inclined plane 22. The exterior of the mat is covered with the same weatherproofing material to allow the device to be deployed along exterior doors without worrying about water damage or weathering of the device.

Figure 3:
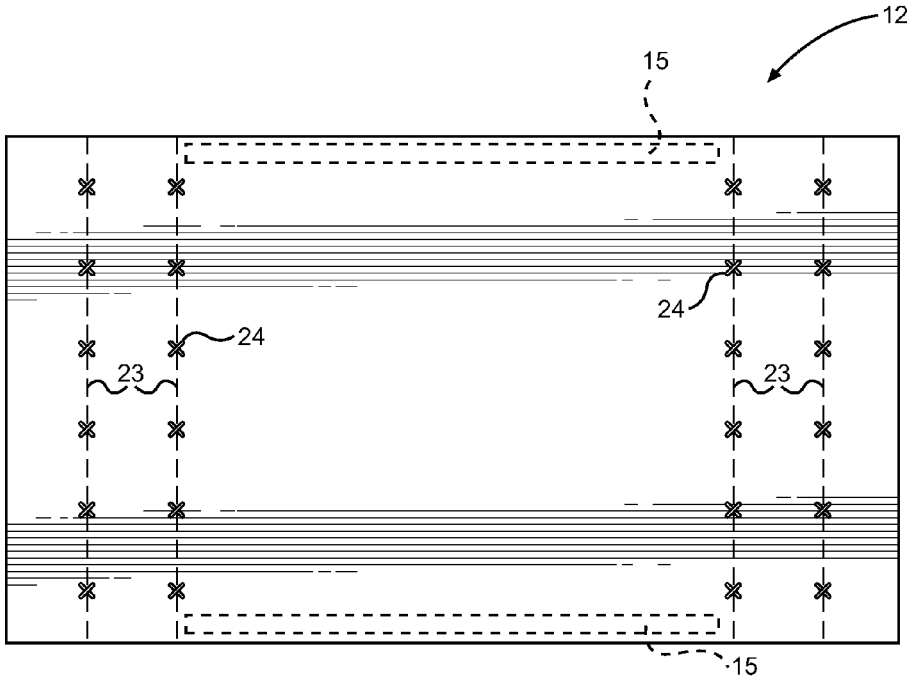
FIG. 3 shows an embodiment of the present invention that provides removable outer portions for sizing the mat for a given threshold width.

Referring now to FIG. 3, there is shown an overhead view of yet another embodiment of the present invention, wherein the mat 12 is provided having a plurality of removable portions along its lateral sides. In order to size the mat 12 to the particular threshold, the width of the mat must be less than that of the threshold to prevent clumping or bunching. It is contemplated that perforations or sewed lines of connection 23 having readily removable stitching 24 may be provided for separating the main body of the mat from outer portions. This allows the overall width of the mat to be tailored for the particular threshold, and eliminates the need for the user to manually cut the mat material during this fitting process. The mat lines of connection 15 are positioned along the body section and may or may not extend to the removable outer portions.

In furtherance to the ability of the present mat to be adjustable to differing threshold widths, the lines of connection 23 may be provided as fold lines rather than separation lines, and the stitching 24 may be provided along the inner and outer edges of the fold lines 23 such that a small slit is revealed to improved folding the extraneous outer portion of the threshold mat within a narrower threshold width. These means of trimming and folding the threshold are provided as embodiments that are designed to allow the user to adjust the width of the threshold mat to the particular threshold without requiring the user to cut through several layers of fabric and interior material when deploying the present invention.

For the application of crawling children: as babies learn to crawl, they may occasionally encounter steps or thresholds to exterior spaces. Many children enjoy going in and out of the house repeatedly so that they join family outdoors or explore their surroundings. The foundation of the home, whether brick, wood, or concrete, may contain sharp edges that can injure a crawling child. At these locations, a crawling child will likely scrape his or her knees, legs, and feet on the foundation as they crawl. Parents often feel the need to pick the child up when entering and exiting the home to ensure their safety. The present invention is designed to protection crawling children as they enter and exit the home over a doorway threshold. The present mat offers a padded surface that covers the entire width of the door threshold and extends over its elements to prevent contact therewith as the child crawls along the upper surface of the mat and over the threshold. The present invention allows children to explore their surroundings safely by protecting them from the sharp edges and rough exterior of the doorway foundation. The device also keeps the child clean as they crawl in and out of the doorway, which is generally an unsanitary location that is less frequently cleaned due to its location. Once installed, parents will be able to let their children enter and exit the home on their own accord and with the peace of mind that the child is not going to be harm from the elements of a doorway threshold.

Alternate uses include the ability of the covering to improve aesthetics of an aging threshold area, without requiring the users or homeowners to make major repairs or updates on the threshold area for this purpose. The mat is one that is comfortable both to walk upon and crawl (as for a child), therefore locomotion of a general type is supported by the present mat while shielding users to the elements and dirty surfaces most commonly found in these areas.

The present invention is placed in an entryway of a home or along the sill of a doorway to prevent a contact with the edges and elements of the threshold as they crawl thereover. The device comprises of a thin, rubberized mat that is secured within a weatherproof exterior cover. The cover may be removable from the interior layer for washing the device and preventing dirt accumulation. The covering layers form a pouch within which the interior layer is placed, while an edge of the pouch may be opened or secured closed when accessing the pouch interior. The device is adhered to the outside portion of the door threshold using a secure line of connection, while the interior edge of the mat is likewise secured to the threshold or to an interior surface along the opposite side of the doorway, depending on the length of the mat and user preferences. The mat lies over the outside portion of the threshold and covers the foundation upon which the threshold sits. It is desired that the mat provide a protective crawling surface, while at the same time does not interfere with the operation of the door once installed. The cover is washable and is may be provided in a variety of different colors and patterns to suit the user.

It is submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A threshold mat, comprising:

a surface cover having a thickness, an upper and underside surface, opposing edges forming an interior edge and an exterior edge, and lateral edges that connect said interior and exterior edges;

said underside surface adjacent to said interior and exterior edges comprising a line of connection to secure said surface cover to a support surface;

said thickness comprising an interior layer sandwiched between an upper and lower layer of water-proof weathering material;

wherein said lateral edges connect to removable covering side portions that are connected along readily removable lines of connection, said side portions being removable so as to control said interior and exterior edge lengths.

2. The device of claim 1, wherein said side portion lines of connection comprise removable stitching and a region of discontinuous covering material that allow separation of said side portions without cutting said covering interior layer or upper and lower layer of water-proof weathering material.

3. A threshold mat, comprising:

a surface cover having a thickness, an upper and underside surface, opposing edges forming an interior edge and an exterior edge, and lateral edges that connect said interior and exterior edges;

said underside surface adjacent to said interior and exterior edges comprising a line of connection to secure said surface cover to a support surface;

said thickness comprising an interior layer sandwiched between an upper and lower layer of water-proof weathering material;

wherein said lateral edges connect to foldable side portions that are connected along readily hingeable lines of connection, said side portions being foldable to control said interior and exterior edge lengths;

wherein said side portion hingeable lines of connection comprise an interior and exterior edge slit having removable stitching thereover.

* * * * *